US007316089B2

(12) United States Patent
Brinkman

(10) Patent No.: US 7,316,089 B2
(45) Date of Patent: Jan. 8, 2008

(54) CLIP-ON PRICE CHANNEL

(75) Inventor: Michael E. Brinkman, Belvedere, IL (US)

(73) Assignee: Southern Imperial, Inc., Rockford, IL (US)

( * ) Notice: Subject to any disclaimer, the term of this patent is extended or adjusted under 35 U.S.C. 154(b) by 334 days.

(21) Appl. No.: 10/962,788

(22) Filed: Oct. 12, 2004

(65) Prior Publication Data

US 2006/0075670 A1 Apr. 13, 2006

(51) Int. Cl.
*G09F 3/18* (2006.01)

(52) U.S. Cl. ..... 40/642; 40/657; 40/343; 40/666

(58) Field of Classification Search ..... 40/657, 40/594, 638, 661, 611.05, 661.03, 661.12, 40/658, 642.02; 428/343, 41.7
See application file for complete search history.

(56) References Cited

U.S. PATENT DOCUMENTS 1,333,515 A * 3/1920 Thompson ..... 40/658
1,417,325 A * 5/1922 Hopp et al. ..... 40/658
2,856,711 A * 10/1958 Hobbs ..... 40/651
2,895,241 A * 7/1959 Ferdinand et al. ..... 40/650
5,044,104 A * 9/1991 Hopperdietzel ..... 40/654.01
5,197,215 A * 3/1993 Torsleff ..... 40/654.01
5,473,833 A * 12/1995 Ostrovsky ..... 40/658
6,026,603 A 2/2000 Kump et al. ..... 40/661.03
6,044,104 A * 3/2000 Watanabe ..... 375/142
D425,566 S * 5/2000 Mueller et al. ..... D20/43
6,105,295 A 8/2000 Brinkman et al. ..... 40/661.03
6,263,603 B1 7/2001 Wildrick ..... 40/661
6,568,113 B1 5/2003 Valiulis ..... 40/661.06
6,708,436 B2 3/2004 Nagel ..... 40/661.01
6,898,885 B1 * 5/2005 Nagel ..... 40/661.06
D516,633 S * 3/2006 Kosir ..... D20/44

* cited by examiner

*Primary Examiner*—Lesley D. Morris
*Assistant Examiner*—Shin Kim
(74) *Attorney, Agent, or Firm*—David I. Roche; Baker & McKenzie LLP

(57) ABSTRACT

A clip-on price channel that is designed to clip on to storage room shelving without the use of adhesive tape, nails, screws, etc. The shelf that it is designed to work with is made of wood and has a metal rail attached to the front edge. The price channel has a U-shaped, rear facing flange with opposing fingers at the free-ends that go over the metal rail that is attached to the shelf and grip into grooves between the metal rail and the wood shelf.

12 Claims, 2 Drawing Sheets

Fig 1
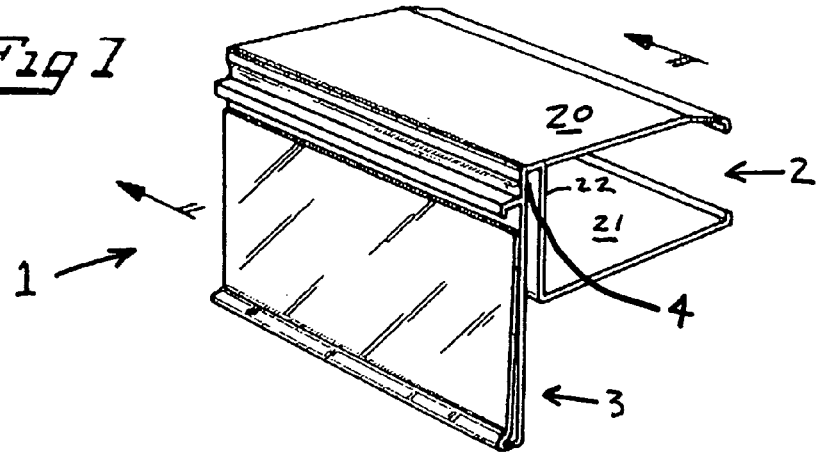
Fig 2
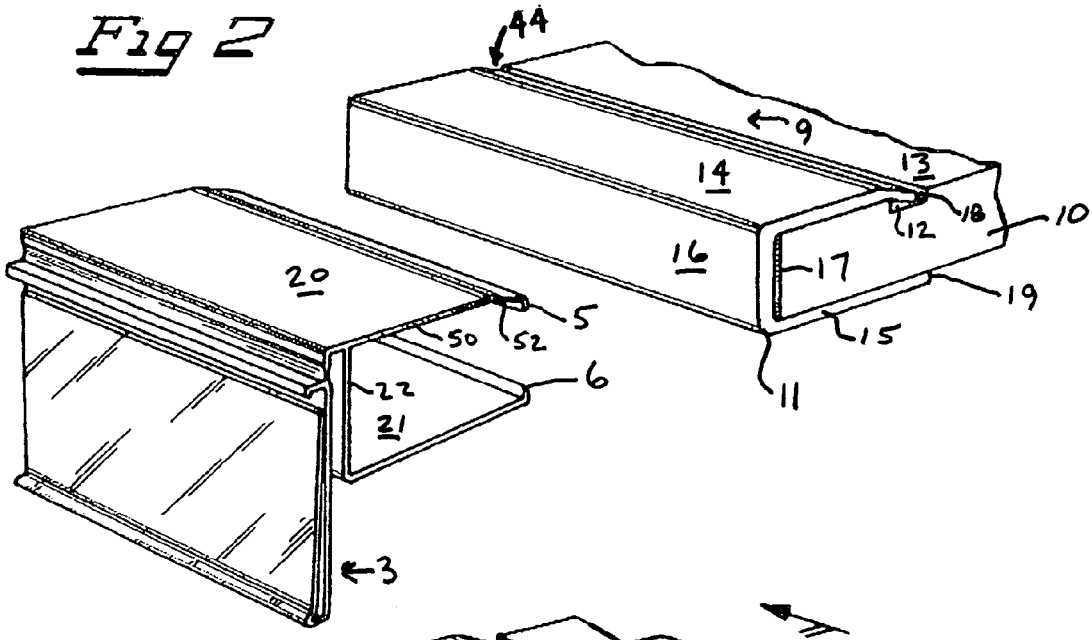
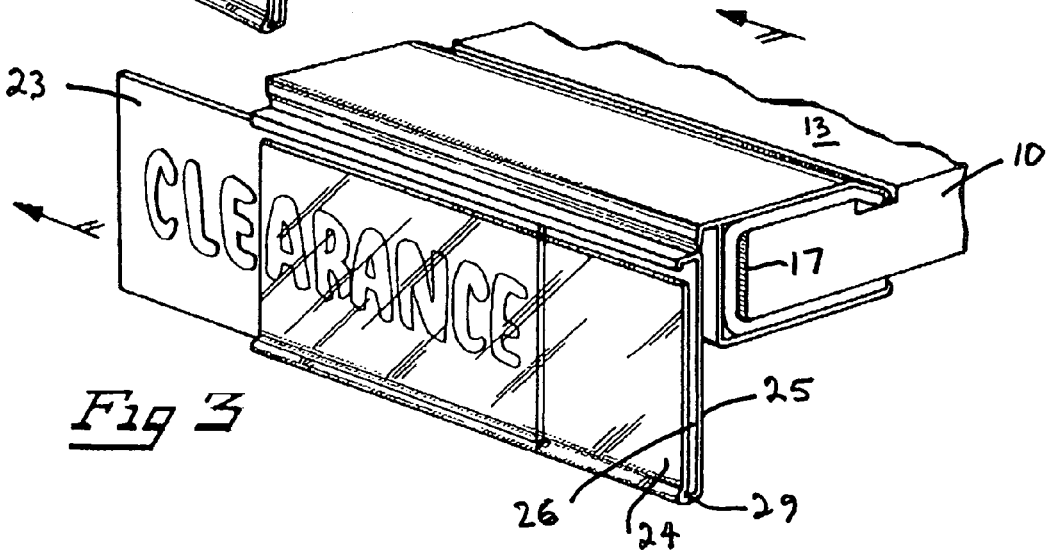
Fig 3

CLIP-ON PRICE CHANNEL

BACKGROUND AND SUMMARY OF THE INVENTION

The inventions described and claimed herein relate to price channels that attach to the front edge of display shelving in retail stores. The primary application of the inventions described and claimed herein is for warehouse-type retail stores that use wood or wood composite shelving, which typically includes metal-reinforced front and rear edges.

Warehouse-type retail stores that sell items in bulk are becoming more popular. Because the bulk items typically come in large quantities, they are heavy and the store's entire stock is may be kept on display. These warehouse-type retail stores use shelving units that were originally designed to be used as storage room shelving, such as the Lozier® S-Series Storage Shelving. These storage room shelving units were not intended to be used as display shelving for consumers and, thus, were not designed to allow for easy attachment of pricing labels. Conversely, typical display shelving units at more conventional retail outlets usually have some means for attaching labels on the front edge of the shelves such as a C-shaped channel into which labels or label holders can be attached.

Because it is important to clearly display advertising, quantity information, pricing and other information directly adjacent to items for sale at retail, the warehouse-type retail stores have resorted to various methods of attaching labels to the front edge of the shelves, such as using adhesive tape, nails, and screws, which have proved unsatisfactory. Adhesive tape is troublesome for the retailers because it is messy and provides insufficient grip on the shelves. As prices or items for sale change, it becomes necessary to change and/or move the pricing labels. The adhesive tape currently used can leave residue on the shelves which is unsightly and time-consuming to remove. Furthermore, labels attached by adhesive tape often fall off of the shelves when consumers either brush up against them or remove items from the shelves. Using nails and screws is even more troublesome because it is time consuming to install and remove labels, not to mention that permanent holes are left in the shelving units when the labels are removed.

Therefore, there is a need for a label channel which can be easily attached to and removed from the leading edge of an industrial shelving unit and which does not leave residue on or otherwise damage the shelves. The label channel of the present invention provides a better method of attaching labels because it results in an improved installation time, an improved grip on the shelf when compared to adhesive, and no damage to the shelves.

The preferred embodiment of the present invention, the clip-on price channel, is designed to clip onto the leading edge of storage room shelving, which are typically made of wood-based composite material (such as particle board) and have a metal rail permanently attached to the front and rear edges. Specifically, the clip-on price channel disclosed and claimed herein has a U-shaped grip that closely conforms to the shape of the edge of the shelf (i.e., the metal rail, if present) and a label holder which is designed to hold a sign or information sheet. At the free ends of the grip, there are two inward facing fingers that are disposed in recesses on the top and bottom surfaces of the shelf. If a metal rail is used, the fingers grip the edges of the metal rail. Where a metal rail is used the upper arm of the metal rail angles toward the lower arm. The upper arm angles at its edge where the clip-on price channel finger grips. The upper arm angles into a groove on the upper surface of the wood-based shelving. The metal rail upper arm angles at the end so as to avoid any jagged edges or abutments on the surface of the shelf. This allows for easy sliding on and off of items on the shelf. The label holder is attached to the grip of the price channel by a connector that may be in the form of a flexible hinge to allows the label holder to flex up and out of the way when the price channel is attached to the shelf and products on the shelf below are removed.

BRIEF DESCRIPTION OF THE DRAWINGS

FIG. 1 is a perspective view of a clip-on price channel as described and claimed in more detail below;

FIG. 2 is a perspective view of a clip-on price channel and shelf, just prior to engagement of the clip-on price channel with the leading edge of the shelf;

FIG. 3 is a perspective view of a clip-on price channel, shelf, and label, just after engagement of the clip-on price channel with the leading edge of the shelf and during insertion of a label into the price channel;

Figure 4:
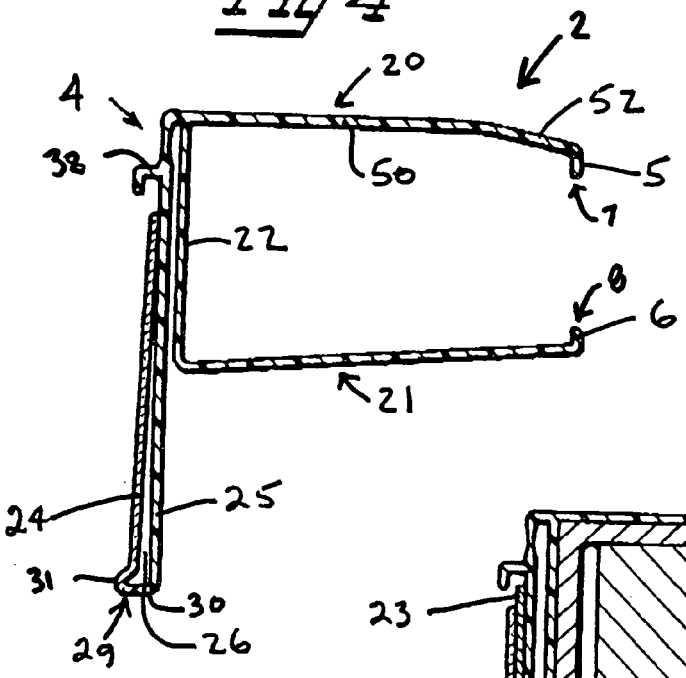
FIG. 4 is a cross-sectional view of a clip-on price channel.

It should be understood that the drawings are not necessarily to scale and that the embodiments are sometimes illustrated by graphic symbols, phantom lines, diagrammatic representations and fragmentary views. In certain instances, details which are not necessary for an understanding of the inventions described and claimed herein or which render other details difficult to perceive may have been omitted. It should be understood, of course, that the inventions described herein are not necessarily limited to the particular embodiments illustrated herein.

The upper arm 20 of the shelf grip 2 angles 52 toward the lower arm 21 right before the upper finger 5 extends at free end 7 to conform with the angle on the metal rail.

DETAILED DESCRIPTION OF THE DRAWINGS

FIG. 1 shows a clip-on price channel 1. The clip-on price channel 1 has three sections: a shelf grip 2, a label holder 3, and a link 4 that attaches the grip 2 to the label holder 3. The channel 1 is preferably an extrusion of a clear, transparent poly vinyl chloride (PVC).

Figure 5:
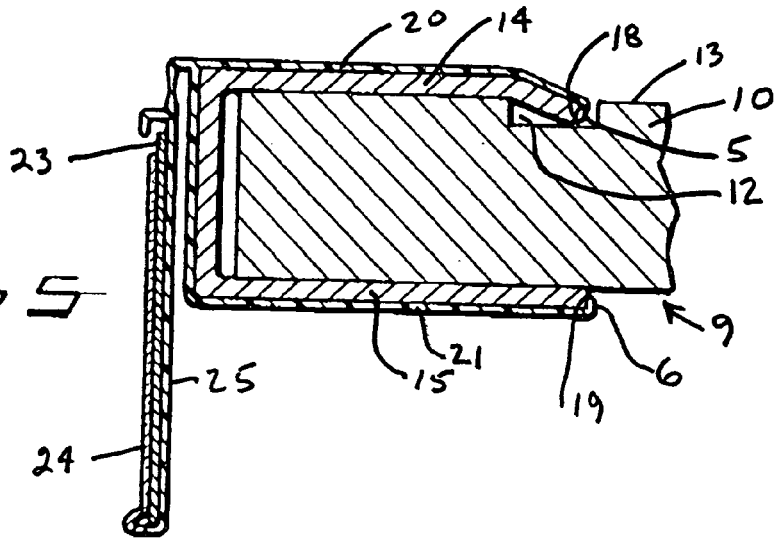
FIG. 5 is a cross-sectional view of a clip-on price channel, shelf, and label, just after engagement of the clip-op price channel with the leading edge of the shelf and insertion of a label into the price channel.
Figure 7:
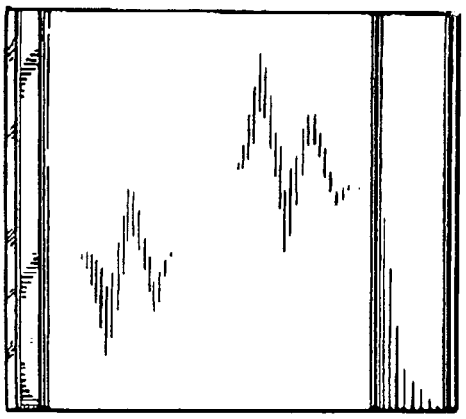
FIG. 7 is a top view of a clip-on price channel.
Figure 8:
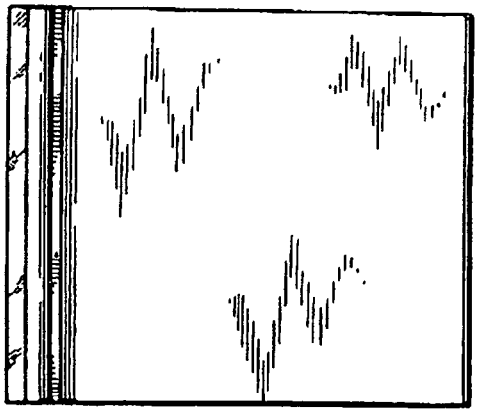
FIG. 8 is a bottom view of a clip-on price channel.

The shelf grip 2 is configured to mate with a storage room shelf 9, such as the Lozier® S-Series Storage Shelving, as shown in FIG. 2. Such shelving 9 is typically comprised of a particle board 10 (or other wood-based composite) having a metal rail 11 affixed to the front (and rear) edge. The metal rail 11 is typically U-shaped and permanently affixed to the long edges of the shelf. The rail typically has an upper section 14 and a lower section 15 extending from opposite ends of a front plate 16. The wood board 10 has a single groove 12 on the top side 13 into which the upper section 14 of metal rail 11 extends, firmly attaching the metal rail 11 to the front edge 17 of the wood board 10. A similar rail is attached to the rear edge of the board 10. The shelf 9 has a groove 44 between the edge of the upper section 14 of the metal rail 11 and the wood portion 10 of the shelf 9, as shown in FIG. 5.

As shown in FIG. 4, the shelf-grip 2 is also U-shaped, preferably closely conforms to the shape of the metal rail 11, and has a upper arm 20, a lower arm 21, and a front panel 22. The upper arm 20 is approximately perpendicular to the front panel 22 while the lower arm 21 is angled slightly towards the upper arm 20 to provide a tight connection with the shelf 9. The upper arm 20, lower arm 21 and front panel 22 correspond to the upper section 14, lower section 15 and front plate 16 of the metal rail 11. The upper section 14 and lower section 15 of the rail are generally parallel when attached to the shelf providing the shelf with parallel upper and lower surfaces at the edges of the shelf, although they may be formed with an included angle of less than 90 degrees to that the rail grips the edge of the shelf.

Similarly, when attached to the edge of the shelf, the upper section 14 and lower section 15 of the grip 2 are parallel. However, to afford the grip 2 of the channel 1 with some gripping force, the upper section 14 and lower section 15 are preferably extruded with an included angle of less than 90 degrees (between 75 and 89 degrees). The included grip angle of the upper and lower sections, 14 and 15, in FIG. 5 is about 83 degrees. However, the size of the angle will increased or decreased, depending upon the thickness and stiffness of the material used to make the channel 1.

The shelf grip 2 has two opposing fingers 5 and 6 at both free ends 7 and 8 of the upper arm 20 and the lower arm 21, respectively. When the clip-on price channel 1 is engaged with the shelf 9, the upper finger 5 fits into the groove 44 between the metal rail 11 and wood board 10 and grips against the upper end surface 18 of the upper section 14 of the metal rail 11, as shown in FIGS. 3 and 5. The lower finger 6 grips against the lower end surface 19 of the lower section 15 of the metal rail 11. The shelf grip 2 is resilient such that the fingers 5 and 6 positively engage with the end surfaces 18 and 19 of the metal rail 11 and hold the price channel 1 firmly in place.

The label holder 3 is designed to hold a sign or information sheet 23 that is much greater in size than the leading edge 17 of the shelf 9, as shown in FIG. 3. This allows the retailer to advertise merchandise in a manner that will be more likely to attract the attention of consumers than a label or sticker attached to the leading edge 17. In the preferred embodiment as shown in FIG. 4, the label holder 3 is generally comprised of a front panel 24 and a back panel 25 between which is formed a channel 26. The back panel 25 is held by the link 4. The front panel 24 is attached to the back panel 25 by a interconnection 29, which allows the front panel 24 to be pulled away from the back panel 25 such that a sign or information sheet 23 can be inserted into the channel 26. The interconnection 29 is also resilient such that the front panel 24 is forced against the back panel 25, effectively holding the sign or information sheet 23 firmly in the channel 26. The interconnection 29 is enlarged to give structural strength to the label holder 3. A bottom edge 30 extends horizontally from the back panel 25, and an arcuate return 31, which is generally convex, connects the bottom edge 30 to the front panel 24.

The label holder 3 also has an overhang 38 which is cantilevered outwardly from the back panel 25 to overhang the front panel 24, effectively preventing dust and spilled liquids from entering the channel. The overhang 38 has a downward bend forming a short vertical lip 35. The short vertical lip 35 extents from the top flange 36 to protect the sign or information sheet from dust or liquid flowing downwardly from the edge of the shelf. The invention described herein is not limited to the particular label holder described above. Indeed, the label holder could take any of numerous alternative forms, such as a label channel with a top-hinged front panel as described in U.S. Pat. No. 6,568,113, which is incorporated herein by reference. A hinge 41 extends downwardly from the 90° bend and has a reduced thickness that allows the label holder 3 to flex up and out of the way when the price channel is attached to the shelf and products on the shelf below are removed.

Figure 6:
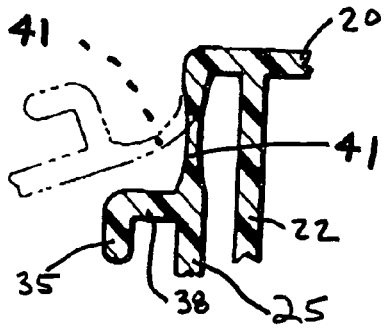
FIG. 6 is an exploded cross-sectional view of the hinge.

FIG. 6 is an exploded view of the link 4 which shows the starting position of the label holder 3 in solid lines and lifted position in dotted lines. In one alternative embodiment, the link may be rigid; i.e., does not incorporate a hinge. In another embodiment, the label holder 3 could extend directly from or be an integral part of the front plate 16 the shelf grip 2.

While the invention has been described with reference to particular embodiments which has been shown in the figures and discussed above, it will be apparent to those skilled in the art that numerous variations, modifications and improvements may be made to the invention described herein without departing from the spirit and scope of the appended claims.

For example, but not by way of limitation, the shelving to which a channel, like the ones described herein is attached, typically includes a metal channel affixed to the front and rear edges of a shelf. The metal channel or rail provides structural support for the shelf and protects the edges of the shelf. The metal channel also typically provides a means by which the shelf may be connected (often temporarily) to a vertical component of the shelving structure. For certain applications, there be materials of which the shelf may be made that do not require the added structural strength afforded by the attachment of a metal channel or rail along the long edges of one or more of the shelves in the shelving structure. In such an instance, the shelf may have an upper and lower groove formed directly (e.g., cut from) the upper and lower surface of the shelf, and these grooves may receive the fingers of a channel made in accordance with the inventions shown and described herein. By eliminating the metal channel or rail, significant cost may be saved, and an extruded price channel as described and claimed herein could perform the edge protection that may have previously been provided by a metal channel or rail. In such cases, a much shorter metal component might be affixed to the ends of the shelf to provide a means for attaching the shelf to a vertical support without having the metal run the full length of the shelf.

I claim:

1. An elongated clip-on label holder in combination with a shelf, the shelf having a groove on a top side near a front edge of the shelf and a protective rail covering a front edge of the shelf and engaging said groove, the label holder comprising: a label holding section held by a connecting section, the connecting section extending from a shelf gripping section; the shelf gripping section having a rear-facing, U-shaped flange that closely conforms to the shape of the edge the shelf; the shelf gripping section having two opposing fingers, one of which mates with the groove on the top of the shelf; each of the fingers engaging a rear facing edge of at the free end of the rail; the connecting section having a horizontal section, a 90 degree bend, a vertical section and a reduced thickness to form a hinge that allows the label holding section to be rotated such that the label holding section can be moved out of the way to access a lower shelf, the horizontal section extending from a top corner of the shelf gripping section to the 90 degree bend; the vertical section extending downward from the 90 degree bend; the hinge extending below the vertical section; and, the label holding section extends below the hinge.

2. The clip-on label holder as in claim 1 wherein: the label holding section has a front panel, a back panel, a flexible interconnection, and a ledge; the back panel is held at its top by the hinge; the back panel is connected its bottom to the front panel by the flexible interconnection forming a pocket between the panels; the flexible interconnection is resilient, tends for force the panels together, and permits the front panel to be pulled away so that a label can be inserted in the pocket; and, the ledge forwardly extends from the top of the back panel to prevent dust and liquids from entering the pocket and has a 90 degree downward bend to form a top flange for the pocket.

3. The clip-on label holder as in claim 2 wherein: the flexible interconnection has a bottom edge and an arcuate section; the bottom edge extends horizontally from the bottom section of the back panel; and, the arcuate section has a generally convex shape and connects the bottom edge of the flexible interconnection to the front panel.

4. The clip-on label holder as in claim 2 wherein: the shelf is comprised of a wood board and a metal rail which grips onto the front edge of the board; the rail is generally U-shape and has an upper section and a lower section extending from opposite ends of a side section; the upper section, at a leading edge of the groove, bends at an angle into the grove; the rear facing, U-shaped flange has a corresponding upper section and a corresponding lower section extending from opposite ends of a corresponding side section; the corresponding upper, lower and side sections of the flange generally conform to the shape of the upper, lower and side sections of the rail the two opposing fingers of the flange extend inward from the free ends of the corresponding upper section and the corresponding lower section and grip against the end surfaces of the upper section and lower section.

5. In combination with a shelf having a protective rail connected to a front edge of the shelf, the rail having a U-shaped cross-section with two end surfaces at distal ends of upper and lower arms that define the U-shaped cross-section, the upper arm having a sloped portion engaging a groove in the upper surface of the board, a label holder comprising:

a label holding section;

a rail gripping section;

a connecting section joining the label holding section and the rail gripping section, the connecting section extending from the shelf gripping section;

the shelf gripping section having a rear-facing U-shaped from that closely conforms to opposing upper and lower surfaces of the U-shape cross-section of the rail;

the shelf gripping section having two opposing fingers that grip against the arms of the rail and engage the two end surfaces of the arms of the rail;

the upper one of said fingers extending into said groove in the upper surface of the shelf; and the label holder being made of a resilient material so as to be capable of being clipped onto the shelf.

6. The combination of claim 5 wherein the connecting section has a reduced thickness to form a hinge that allows the label holding section to be rotated such that the label holding section can be moved out of the way to avoid restricting removal of items from beneath the shelf, the connecting section having a reduced thickness to form a hinge that allows the label holding section to be rotated such that the label holding section can be moved out of the way to access a lower shelf.

7. An elongated clip-on label holder in combination with a shelf, the shelf having a groove on a top side near a front edge of the shelf and a protective rail covering a front edge of the shelf and engaging said groove, the label holder comprising: a label holding section held by a connecting section, the connecting section extending from a shelf gripping section; the shelf gripping section having a rear-facing, U-shaped flange that closely conforms to the shape of the edge the shelf; the shelf gripping section having at least one finger that mates with the groove on the top of the shelf; the at least one finger engaging a rear facing edge of at the free end of the rail; the connecting section having a horizontal section, a 90 degree bend, a vertical section and a reduced thickness to form a hinge that allows the label holding section to be rotated such that the label holding section can be moved out of the way to access a lower shelf, the horizontal section extending from a top corner of the shelf gripping section to the 90 degree bend; the vertical section extending downward from the 90 degree bend; the hinge extending below the vertical section; and, the label holding section extends below the hinge.

8. The clip-on label holder as in claim 7 wherein: the label holding section has a front panel, a back panel, a flexible interconnection, and a ledge; the back panel is held at its top by the hinge; the back panel is connected its bottom to the front panel by the flexible interconnection forming a pocket between the panels; the flexible interconnection is resilient, tends for force the panels together, and permits the front panel to be pulled away so that a label can be inserted in the pocket; and, the ledge forwardly extends from the top of the back panel to prevent dust and liquids from entering the pocket and has a 90 degree downward bend to form a top flange for the pocket.

9. The clip-on label holder as in claim 8 wherein: the flexible interconnection has a bottom edge and an arcuate section; the bottom edge extends horizontally from the bottom section of the back panel; and, the arcuate section has a generally convex shape and connects the bottom edge of the flexible interconnection to the front panel.

10. The clip-on label holder as in claim 8 wherein: the shelf is comprised of a wood-based board and a metal rail which grips onto the front edge of the board; the rail is generally U-shape and has an upper section and a lower section extending from opposite ends of a side section; the upper section, at a leading edge of the groove, bends at an angle into the grove; the rear facing, U-shaped flange has a corresponding upper section and a corresponding lower section extending from opposite ends of a corresponding side section; the corresponding upper, lower and side sections of the flange generally conform to the shape of the upper, lower and side sections of the rail the finger of the flange extending inward from the free end of the corresponding upper section and gripping against the end surfaces of the upper section.

11. In combination with a shelf having a protective rail connected to a front edge of the shelf, the rail having a U-shaped cross-section with two end surfaces at distal ends of upper and lower arms that define the U-shaped cross-section, the upper arm having a sloped portion engaging a groove in the upper surface of the board, a label holder comprising:

a label holding section;

a rail gripping section;

a connecting section joining the label holding section and the rail gripping section, the connecting section extending from the shelf gripping section;

the shelf gripping section having a rear-facing U-shaped form that closely conforms to opposing upper and lower surfaces of the U-shape cross-section of the rail;

the shelf gripping section having at least one finger that engages the end surface of at least one of the arms of the rail;

the finger extending into said groove in the upper surface of the shelf; and the label holder being made of a resilient material so as to be capable of being clipped onto the shelf.

12. The combination of claim 5 wherein the connecting section has a reduced thickness to form a hinge that allows the label holding section to be rotated such that the label holding section can be moved out of the way to avoid restricting removal of items from beneath the shelf, the connecting section having a reduced thickness to form a hinge that allows the label holding section to be rotated such that the label holding section can be moved out of the way to access a lower shelf.

* * * * *